United States Patent [19]

Huzyak

[11] 4,059,251

[45] Nov. 22, 1977

[54] AGITATOR FOR MELTING FURNACE

[76] Inventor: Paul Huzyak, 1227 Pennsylvania Ave., Monaca, Pa. 15061

[21] Appl. No.: 739,721

[22] Filed: Nov. 4, 1976

[51] Int. Cl.[2] ..... C22B 9/00

[52] U.S. Cl. ..... 266/235

[58] Field of Search ..... 259/108, 109, 121, 122; 266/235

[56] References Cited

U.S. PATENT DOCUMENTS

| | | | |
|---|---|---|---|
| 1,301,374 | 4/1919 | Brown | 266/235 |
| 2,295,098 | 9/1942 | Cornell | 259/122 |
| 3,249,342 | 5/1966 | Mikkelsen | 259/108 |
| 3,858,640 | 1/1975 | Sifferlen | 266/235 |
| 3,861,660 | 1/1975 | Ammann et al. | 266/235 |

*Primary Examiner*—Gerald A. Dost

*Attorney, Agent, or Firm*—Clarence A. O'Brien; Harvey B. Jacobson

[57] ABSTRACT

An agitator assembly for use with a melting furnace such as used for preparing metal to mold bullets has a motor mount slidably disposed on a support arrangement for movement toward and away from the furnace. Rotated by a motor mounted on the motor mount is an agitator element selectively inserted into and removed from the furnace by appropriate movement of the motor mount. A cover plate also is movably mounted on the support arrangement for placement over the access opening of the furnace to prevent splash from the furnace whenever the agitator element is operating within the furnace.

6 Claims, 6 Drawing Figures

3
40
42
44
18
38
22
24
10
26
16
50
46
4
56
4
32
28
34
32
60
36
58
14
52
3
20

40
42
18
44
54
22
22
56
56
50
20
20
46
28
32
32
62
30
12

AGITATOR FOR MELTING FURNACE

BACKGROUND OF THE INVENTION

1. Field of the Invention

This invention relates generally to an agitator assembly, and particularly to an agitator for use with melting furnaces such as conventionally employed in conjunction with the casting of bullets and the like.

2. Description of the Prior Art

Persons who wish to make their own bullets have a problem in getting all bullets to be of the same weight. This problem is created by two factors. The first is that the tree metals commonly used in bullets, namely lead, tin, and antimony, have different weights and tend to segregate in a melting furnace. This results in different ratios of the three metals between the first and last bullet poured from a melt. The second factor is that impurities, or dross, that are present in the metals frequently becomes mixed into the bullets and creates a different weight in such bullets. As a result of these two factors, bullets poured from the same melt may differ in weight which will cause the bullets to travel different distances even though the powder charge is the same. The bullets may also differ in that some of them may have a larger proportion of one metal on one side of the bullet than on the other side and this will bring a curving effect into the trajectory of the bullet.

It is generally known to lower equipment into a processing chamber. U.S. Pat. No. 3,379,818, issued Apr. 23, 1968 to P. J. Wynne, discloses an electric arc furnace wherein an anode is lowered into the furnace by means of a suitable drive assembly. A cover is employed in conjunction with the drive assembly for being brought over the access opening of the furnace when the anode is lowered in order to seal off the furnace during operation. Further, U.S. Pat. Nos. 2,219,706, issued Oct. 29, 1940 to T. Jones, and 3,865,353, issued Nov. 21, 1972 to E. Fischer, disclose agitating arrangements wherein an agitator element is selectively lowered into a chamber the contents of which are to be agitated.

SUMMARY OF THE INVENTION

It is an object of the present invention to provided an agitator assembly for use with a melting furnace which will result in articles poured from the same melt having the same weight.

It is another object of the present invention to provide an agitator assembly for use with a melting furnace used for casting bullets wherein each of the bullets cast will have an even mix of material throughout and be substantially free of dross.

These and other objects are achieved according to the present invention by providing an agitator assembly having: a support arrangement disposed extending from a furnace whose contents are to be agitated; a motor mount disposed on the support arrangement for movement toward and away from the furnace; an elastic arrangement connected to the support and to the motor mount for biasing the motor mount away from the furnace; and a clamp provided on the motor mount for releasably engaging the support arrangement and retaining the motor mount against the bias of the elastic means at a desired location on the support.

A cover plate is advantageously mounted on the support arrangement for movement toward and away from the furnace and selectively covering an intake opening of the furnace so as to prevent splash from the furnace during agitation of the contents of the furnace.

A shaft extending from an electric motor mounted on the motor mount passes through an aperture provided in the cover plate and has affixed to its lower end a suitable agitator element which is inserted into the furnace for agitating the melt from which bullets come and the like, are to be cast.

The support arrangement preferably includes a pair of spaced, substantially parallel rods on which the motor mount and cover plate is slidably arranged. Advantageously, the rods are mounted on and extend upwardly from the furnace, being effectively continuations of the columns supporting the furnace itself.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
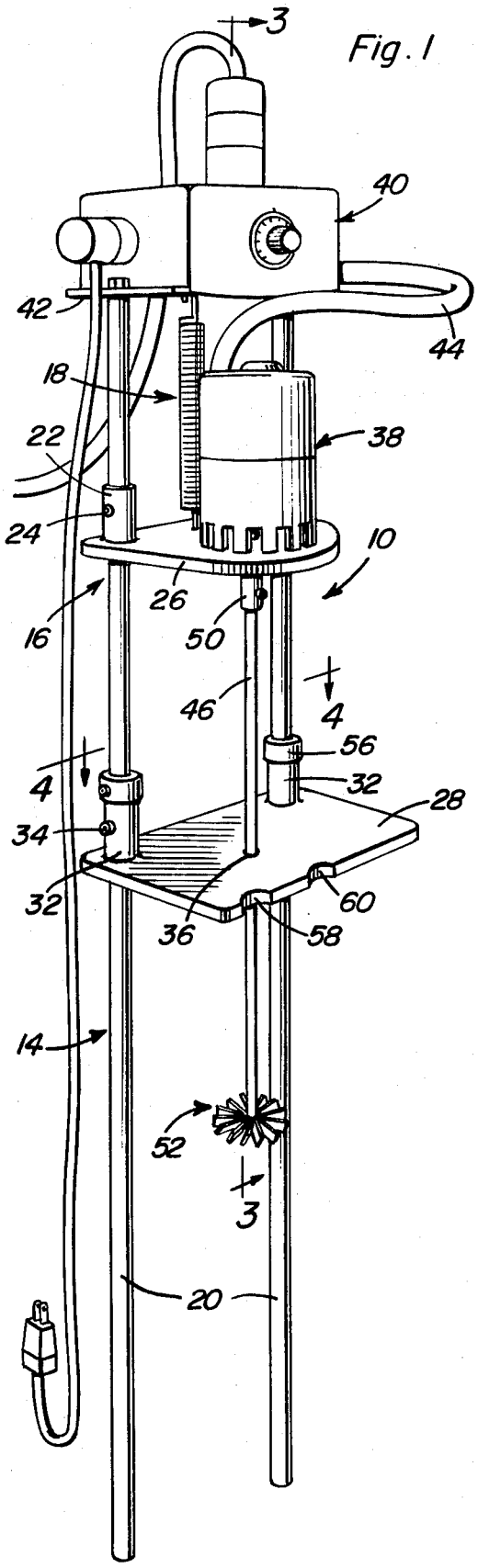
FIG. 1 is a prospective view showing an agitator assembly according to the present invention with a suitable actuating motor and motor controller mounted thereon.

Referring now more particularly to the figures of the drawings, there is shown an agitator assembly 10 according to the present invention which is primarily intended to be used with a conventional melting furnace 12, such as a furnace manufactured by the "Lyman" Company. This furnace 12 is mounted on a suitable base as by a pair of upright supports. The latter may be part of a support arrangement 14 partially forming the agitator assembly 10 and having slidably disposed thereon a motor mount 16 arranged for movement toward and away from furnace 12 and being biased away from furnace 12 as by a conventionally coiled tension spring 18 connected to the support arrangement 14 and motor mount 16.

The support arrangement 14 advantageously includes a pair of spaced, substantially parallel rods 20, with the motor mount 16 being slidably arranged on rods 20 as by a pair of bushings 22 each provided with a set screw 24 for permitting clamping and unclamping of the associated bushing 22 to a respective rod 20. Bushings 22 are attached to a plate 26 provided with a suitable opening for receiving the shaft of a motor.

Assembly 10 also includes a cover plate 28 slidably mounted on the rods 20 for movement toward and away from the furnace 12 for selectively covering an intake opening 30 of furnace 12 in order to prevent splash from opening 30 during agitation of the contents of furnace 12 by assembly 10. Attached to cover plate 28 are a pair of suitable sleeves 32 which slidingly embrace respective rods 20 and are provided with set screws 34 for permitting clamping and unclamping of sleeves 32 to the rods 20.

Cover plate 28 is provided with an aperture 36 for a purpose to become clear below. A conventional electric motor 38 is mounted on plate 26 of motor mount 16 and has associated therewith a conventional controller 40 mounted on a plate 42 disposed at the very top of rods 20. Motor 38 is connected to controller 40 as by a suitable cord 44, while controller 40 is itself connected to a suitable source of electric power (not shown) by a conventional line cord.

A shaft 46 is connected to the output shaft 48 of motor 38 as by a conventional coupling 50 for rotation by motor 38 and is slidably disposed in aperture 36 of cover plate 28 for permitting relative movement between motor mount 16 and cover plate 28. A suitable agitator element 52 is affixed to the lower end of shaft 46 so as to be arranged for selective insertion through opening 30 and into the interior of furnace 12 in order to agitate the contents of furnace 12. Cover plate 28 is disposed between motor mount 16 and the agitator element 52.

Figure 2:
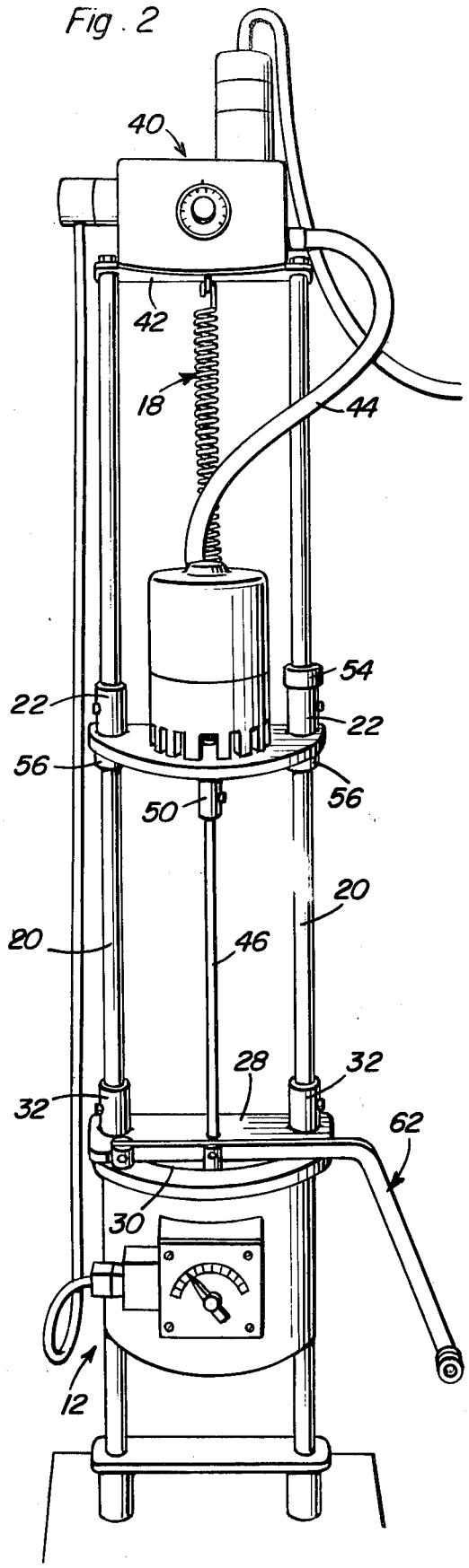
FIG. 2 is a prospective view showing the agitator assembly of FIG. 1 mounted on a conventional melting furnace.
Figure 3:
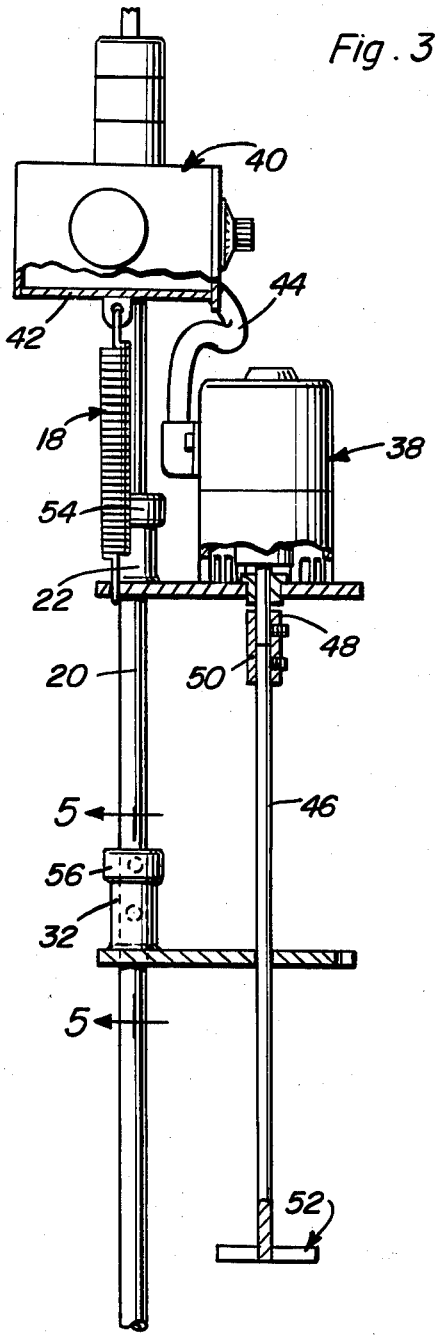
FIG. 3 is a fragmentary, sectional view taken generally along the line 3—3 of FIG. 1.
Figure 6:
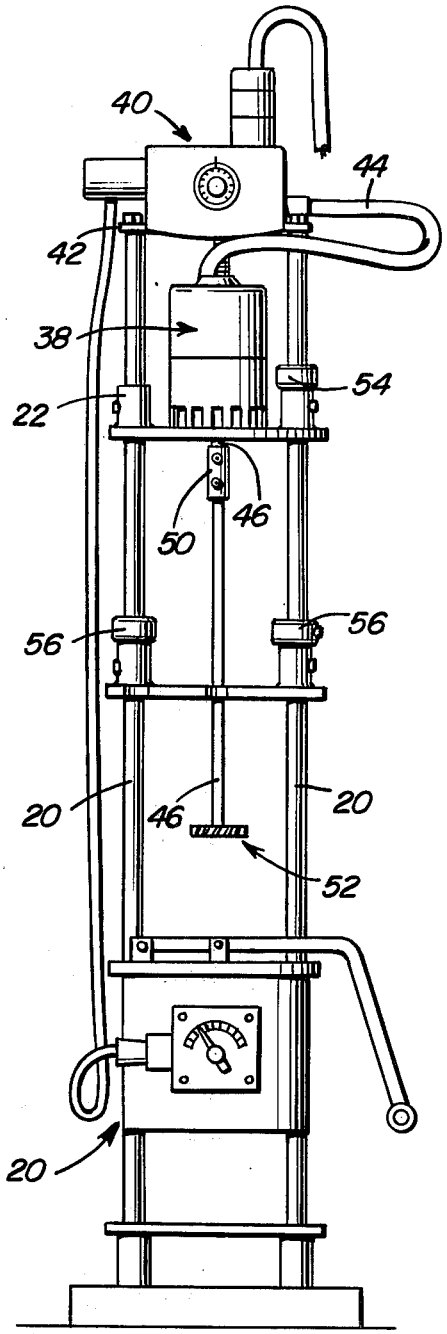
FIG. 6 is a front elevational view showing the arrangement of FIG. 2, but with the agitator assembly moved to its inoperative position.
Figure 4:
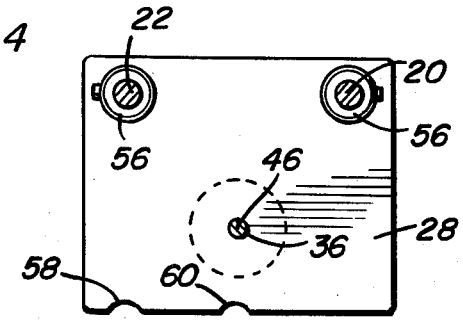
FIG. 4 is an enlarged, sectional view taken generally along the line 4—4 of FIG. 1.
Figure 5:
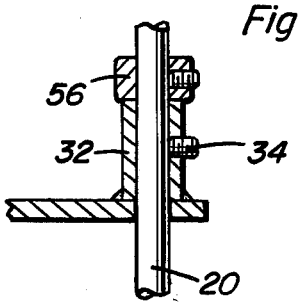
FIG. 5 is an enlarged, fragmentary, sectional view taken generally along line 5—5 of FIG. 3.

While the set screws 24 and 34 associated with bushings 22 and sleeves 32, respectively, provide for clamping of the motor mount 16 and cover plate 28 to the two rods 20 at desired locations on the rods 20, it is desirable to employ clamp collars 54 and 56 in order to further insure that motor mount 16 will be held in its predetermined position during an operating cycle of assembly 10. In addition, these collars 54 and 56 can be used as stops so as to facilitate proper positioning of the motor mount 16 both when agitator element 52 is inserted into furnace 12 as shown in FIG. 2 and when the agitator 52 is withdrawn from furnace 12 as shown in FIG. 6. More specifically, the clamp collars 56 can function both as downward stops for mounting plate 16 and as upward stops for cover plate 28. Manipulation of conventional set screws can permit the location of clamp collars 54 and 56 to be changed as desirable and necessary.

Recesses 58 and 60 provided in the front edge of cover plate 28 receive parts of the handle arrangement 62, which is itself connected to the operating valve (not shown) of the discharge spout (not shown) both of conventional construction and forming part of furnace 12, in order to permit cover plate 28 to fit tightly as possible around the entire area of opening 30.

OPERATION

To use the assembly 10 the metal first is heated in furnace 12 in a conventional manner until it becomes molten. Then the plate 26 holding the electric motor 38 is pushed down along the substantially vertically upstanding rods 20 until the agitator element 52 is submerged in the molten metal. Plate 26 is held in place by tightening the set screws 24 of the bushings 22 and by bringing the clamp collar 54 down against one of the bushings 22. Further, the plate 26 may be resting against the clamp collars 56. The lower or cover plate 28 is now pushed down so as to cover the furnace opening 30 and the set screws 34 associated with sleeves 32 of plate 28 tightened against the upright rods 20 in order to hold the cover plate 28 securely over opening 30. Electric motor 38 is now started so as to rotate the activator or agitator element 52 at a speed preset on the electric motor controller 40. When the metals in furnace 12 are thoroughly mixed the bullets can then be poured in a conventional manner (not shown) with the agitator element 52 remaining in motion. Conventional melting furnaces, such as that mentioned by the "Lyman" Company are made so that a precise amount of metal desired can be ejected when the release pin of the furnace is actuated.

Since the metal is being constantly agitated while the bullets are being poured, it keeps the various component metals from segregating during the pour. The circular motion of the metal creates a vortex that moves the dross away from the nozzle or spout through which the metal is poured out of the furnace 12. This results in bullets of equal ratio of the component metals and mix so that the ratio remains the same throughout the bullet and the bullet is free from all dross. The cover plate 28 is held down on furnace 12 so that the agitator element 52 will not splash molten metal out through opening 30. When the pour is finished and furnace 12 is idle, the clamps are loosened and the motor mount 16 is permitted to lift under the bias of spring 18 so that the agitator element 52 is pulled out of furnace 12 and the latter can be reloaded for another pour.

SUMMARY

As can be readily understood from the above description and from the drawings, an agitator assembly according to the present invention is easily mounted on conventional melting furnace so as to permit agitation of molten metal within the furnace during the time the molten metal is being poured from the furnace into bullet molds, and the like The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. An agitator assembly for use with a melting furnace, comprising, in combination:
   a. a support arrangement disposed extending from a melting furnace whose contents are to be agitated:
   b. a motor mount disposed on the support arrangement for movement toward and away from the furnace;
   c. agitator means mounted on the motor mount for movement therewith and selectively insertable into the furnace for agitating the contents thereof;
   d. clamp means provided on the motor mount for releasably engaging the support arrangement and retaining the motor mount at a desired location on the support arrangement; and
   e. a cover mounted on the support arrangement for movement toward and away from the furnace independently of the motor mount for selectively covering an intake opening of the furnace and preventing splash of the contents of the furnace during agitation of the contents by the agitator means.

2. A structure defined in claim 1, wherein the cover plate is provided with an aperture, and further including an electric motor mounted on the motor mount, with the agitator means including a shaft extending from the electric motor for rotation thereby and disposed in the aperture of the cover plate, and an agitator element affixed to the shaft and arranged for selective insertion into the furnace through the intake opening thereof, the cover plate being disposed between the motor mount and the agitator element.

3. A structure defined in claim 2, further including elastic means connected to the support arrangement and to the motor mount for biasing the mount away from the furnace.

4. A structure as defined in claim 3, wherein the support arrangement includes a pair of spaced, substantially parallel, vertically upstanding rods, with the motor mount and cover plate being slidably arranged on the rods.

5. A structure defined in claim 1, further including elastic means connected to the support arrangement and to the motor mount for biasing the mount away from the furnace.

6. A structure as defined in claim 1, wherein the support arrangement includes a pair of spaced, substantially parallel, vertically upstanding rods, with the motor mount being slidably arranged and clampable on the rods.

* * * * *